US008333207B2

(12) United States Patent
Calhoun et al.

(10) Patent No.: US 8,333,207 B2
(45) Date of Patent: Dec. 18, 2012

(54) SPRAY ARM FOR DIRECTING SPRAY IN A WAREWASHING MACHINE

(75) Inventors: James Scott Calhoun, Corbin, KY (US); Walter Ray Lambert, Bimble, KY (US); Clifford Ernest Neuman, Gray, KY (US)

(73) Assignee: Jackson MSC LLC, Barbourville, KY (US)

( * ) Notice: Subject to any disclaimer, the term of this patent is extended or adjusted under 35 U.S.C. 154(b) by 554 days.

(21) Appl. No.: 12/554,462

(22) Filed: Sep. 4, 2009

(65) Prior Publication Data

US 2010/0051071 A1 Mar. 4, 2010

Related U.S. Application Data

(60) Provisional application No. 61/190,971, filed on Sep. 4, 2008.

(51) Int. Cl.
*B08B 3/00* (2006.01)
*B08B 3/12* (2006.01)
*B08B 6/00* (2006.01)

(52) U.S. Cl. ..... 134/172; 134/56 D; 134/57 D; 134/58 D; 134/176; 134/179; 134/180; 134/198

(58) Field of Classification Search ..... 134/56 D, 134/57 D, 58 D, 172, 176, 179, 180, 198
See application file for complete search history.

(56) References Cited

U.S. PATENT DOCUMENTS

| | | | | |
|---|---|---|---|---|
| 3,236,249 | A | 2/1966 | Everroad | 134/167 |
| 3,645,453 | A * | 2/1972 | Morgan | 239/237 |
| 3,918,644 | A * | 11/1975 | Platt et al. | 239/243 |
| 5,131,419 | A * | 7/1992 | Roberts | 134/50 |
| 5,193,562 | A * | 3/1993 | Rigby et al. | 134/57 D |
| 5,651,380 | A * | 7/1997 | Sargeant et al. | 134/105 |
| 7,314,188 | B2 | 1/2008 | Watson et al. | 239/568 |
| 7,350,527 | B2 * | 4/2008 | Gurubatham et al. | 134/104.1 |
| 7,754,026 | B2 | 7/2010 | Kehl | 134/58 D |
| 2007/0295361 | A1 * | 12/2007 | Thiyagarajan et al. | 134/18 |

FOREIGN PATENT DOCUMENTS

EP 474127 A1 * 3/1992

OTHER PUBLICATIONS

International Preliminary Report on Patentability issued Jan. 25, 2012 in the related PCT/US2010/061061.
International Search Report issued Feb. 11, 2011 in PCT/US2010/061061.

* cited by examiner

*Primary Examiner* — Michael Barr
*Assistant Examiner* — Charles W Kling
(74) *Attorney, Agent, or Firm* — Ohlandt, Greeley, Ruggiero & Perle, L.L.P.

(57) ABSTRACT

An arm includes a tubular body that is rotatable. The tubular body has a first end portion, a second end portion and an intermediate portion between the first end portion and the second end portion. The first end portion is bent in a first direction forming a first angle with the intermediate portion, and the second end portion is bent in a second direction forming a second angle with the intermediate portion. A plurality of nozzles are through the tubular body.

11 Claims, 15 Drawing Sheets

| | | | | | | | | | |
|---|---|---|---|---|---|---|---|---|---|
| | Note: 346.8 value is max. HUE for any temp. above 165. | | | | | 3.03E-17 | 0.265972 | 346.8 | |
| Time | Front | Center | Rear | HUE #1 | Total HUE | HUE #2 | Total HUE | HUE #3 | Total HUE #3 |
| 1 SEC. | 128.41 | 140.357 | 132.773 | 0.0 | 0.0 | 0.0 | 0.0 | 0.0 | 0.0 |
| 2 SEC. | 131.884 | 142.502 | 136.089 | 0.0 | 0.0 | 0.0 | 0.0 | 0.0 | 0.0 |
| 3 SEC. | 134.843 | 144.094 | 138.906 | 0.0 | 0.0 | 1.3 | 1.3 | 0.0 | 0.0 |
| 4 SEC. | 137.491 | 145.397 | 141.088 | 0.0 | 0.0 | 1.9 | 3.2 | 0.0 | 0.0 |
| 5 SEC. | 139.775 | 146.552 | 142.915 | 0.0 | 0.0 | 2.6 | 5.8 | 0.0 | 0.0 |
| 6 SEC. | 141.658 | 147.478 | 144.443 | 0.0 | 0.0 | 3.3 | 9.1 | 1.5 | 1.5 |
| 7 SEC. | 143.284 | 148.25 | 145.813 | 1.1 | 1.1 | 4.0 | 13.1 | 2.1 | 3.6 |
| 8 SEC. | 144.41 | 148.898 | 146.925 | 1.5 | 2.5 | 4.8 | 17.9 | 2.8 | 6.4 |
| 9 SEC. | 145.613 | 149.468 | 147.787 | 2.0 | 4.5 | 5.6 | 23.5 | 3.6 | 10.0 |
| 10 SEC. | 146.538 | 149.926 | 148.554 | 2.6 | 7.1 | 6.3 | 29.8 | 4.4 | 14.4 |
| 11 SEC. | 147.434 | 150.331 | 149.231 | 3.3 | 10.4 | 7.0 | 36.9 | 5.2 | 19.6 |
| 12 SEC. | 148.117 | 150.692 | 149.744 | 3.9 | 14.3 | 7.7 | 44.6 | 6.0 | 25.6 |
| 13 SEC. | 148.788 | 150.979 | 150.106 | 4.7 | 18.9 | 8.3 | 52.9 | 6.6 | 32.3 |
| 14 SEC. | 149.357 | 151.227 | 150.5 | 5.4 | 24.3 | 8.9 | 61.9 | 7.4 | 39.6 |
| 15 SEC. | 149.798 | 151.454 | 150.822 | 6.1 | 30.4 | 9.5 | 71.3 | 8.0 | 47.6 |
| 16 SEC. | 150.242 | 151.713 | 151.155 | 6.9 | 37.3 | 10.1 | 81.5 | 8.7 | 56.4 |
| 17 SEC. | 150.575 | 151.877 | 151.385 | 7.5 | 44.8 | 10.6 | 92.1 | 9.3 | 65.7 |
| 18 SEC. | 150.863 | 152.086 | 151.645 | 8.1 | 52.9 | 11.2 | 103.3 | 10.0 | 75.6 |
| 19 SEC. | 151.268 | 152.26 | 151.888 | 9.0 | 61.9 | 11.7 | 115.0 | 10.6 | 86.3 |
| 20 SEC. | 151.619 | 152.44 | 152.078 | 9.9 | 71.8 | 12.3 | 127.3 | 11.2 | 97.4 |
| 21 SEC. | 151.771 | 152.575 | 152.287 | 10.3 | 82.1 | 12.8 | 140.1 | 11.8 | 109.3 |
| 22 SEC. | 151.94 | 152.689 | 152.435 | 10.8 | 92.9 | 13.2 | 153.3 | 12.3 | 121.6 |
| 23 SEC. | 152.177 | 152.829 | 152.599 | 11.5 | 104.4 | 13.7 | 166.9 | 12.8 | 134.4 |
| 24 SEC. | 152.284 | 152.885 | 152.734 | 11.8 | 116.2 | 13.9 | 180.8 | 13.3 | 147.7 |
| 25 SEC. | 152.447 | 153.022 | 152.84 | 12.3 | 128.5 | 14.4 | 195.2 | 13.7 | 161.4 |
| 26 SEC. | 152.622 | 153.112 | 152.993 | 12.9 | 141.5 | 14.7 | 209.9 | 14.3 | 175.7 |
| 27 SEC. | 152.825 | 153.263 | 153.099 | 13.6 | 155.1 | 15.3 | 225.2 | 14.7 | 190.4 |
| 28 SEC. | 152.921 | 153.326 | 153.229 | 14.0 | 169.1 | 15.6 | 240.8 | 15.2 | 205.6 |
| 29 SEC. | 153.005 | 153.371 | 153.308 | 14.3 | 183.4 | 15.8 | 256.6 | 15.5 | 221.1 |
| 30 SEC. | 153.14 | 153.445 | 153.387 | 14.8 | 198.2 | 16.1 | 272.7 | 15.8 | 236.9 |

Fig. 12a
(Prior Art)

| | | | | | | | | | |
|---|---|---|---|---|---|---|---|---|---|
| 31 SEC. | 153.232 | 153.5 | 153.466 | 15.2 | 213.4 | 16.3 | 289.0 | 16.2 | 253.1 |
| 32 SEC. | 153.225 | 153.58 | 153.54 | 15.2 | 228.6 | 16.7 | 305.7 | 16.5 | 269.6 |
| 33 SEC. | 153.383 | 153.635 | 153.567 | 15.8 | 244.4 | 16.9 | 322.6 | 16.6 | 286.2 |
| 34 SEC. | 153.383 | 153.698 | 153.646 | 15.8 | 260.3 | 17.2 | 339.8 | 17.0 | 303.2 |
| 35 SEC. | 153.531 | 153.794 | 153.725 | 16.5 | 276.7 | 17.7 | 357.4 | 17.3 | 320.5 |
| 36 SEC. | 153.603 | 153.805 | 153.783 | 16.8 | 293.5 | 17.7 | 375.2 | 17.6 | 338.1 |
| 37 SEC. | 153.666 | 153.889 | 153.828 | 17.1 | 310.6 | 18.1 | 393.3 | 17.8 | 355.9 |
| 38 SEC. | 153.779 | 153.958 | 153.873 | 17.6 | 328.1 | 18.4 | 411.7 | 18.0 | 374.0 |
| 39 SEC. | 153.761 | 154.053 | 153.94 | 17.5 | 345.6 | 18.9 | 430.6 | 18.4 | 392.3 |
| 40 SEC. | 153.745 | 153.985 | 153.934 | 17.4 | 363.1 | 18.6 | 449.2 | 18.3 | 410.6 |
| 41 SEC. | 153.824 | 154.199 | 155.129 | 17.8 | 380.9 | 19.7 | 468.8 | 25.2 | 435.8 |
| 42 SEC. | 153.896 | 154.566 | 156.946 | 18.1 | 399.0 | 21.7 | 490.5 | 40.8 | 476.6 |
| 43 SEC. | 154.134 | 154.939 | 159.044 | 19.3 | 418.3 | 23.9 | 514.5 | 71.3 | 548.0 |
| 44 SEC. | 154.562 | 155.491 | 161.012 | 21.7 | 440.0 | 27.7 | 542.2 | 120.4 | 668.3 |
| 45 SEC. | 155.295 | 156.208 | 162.812 | 26.3 | 466.3 | 33.5 | 575.7 | 194.3 | 862.6 |
| 46 SEC. | 155.956 | 157.154 | 164.48 | 31.4 | 497.7 | 43.1 | 618.9 | 302.8 | 1165.4 |
| 47 SEC. | 156.757 | 158.074 | 165.901 | 38.8 | 536.5 | 55.1 | 674.0 | 346.8 | 1512.2 |
| 48 SEC. | 157.592 | 158.971 | 167.263 | 48.5 | 585.0 | 70.0 | 743.9 | 346.8 | 1859.0 |
| 49 SEC. | 158.454 | 159.907 | 168.437 | 61.0 | 645.9 | 89.7 | 833.7 | 346.8 | 2205.8 |
| 50 SEC. | 159.39 | 160.708 | 169.513 | 78.2 | 724.1 | 111.0 | 944.7 | 346.8 | 2552.6 |
| 51 SEC. | 160.202 | 161.435 | 170.222 | 97.1 | 821.2 | 134.7 | 1079.4 | 346.8 | 2899.4 |
| 52 SEC. | 160.918 | 162.05 | 170.368 | 117.4 | 938.6 | 158.7 | 1238.1 | 346.8 | 3246.2 |
| 53 SEC. | 161.273 | 162.326 | 170.318 | 129.0 | 1067.6 | 170.7 | 1408.8 | 346.8 | 3593.0 |
| 54 SEC. | 161.307 | 162.416 | 169.969 | 130.2 | 1197.8 | 174.9 | 1583.7 | 346.8 | 3939.8 |
| 55 SEC. | 161.24 | 162.175 | 169.321 | 127.9 | 1325.8 | 164.0 | 1747.7 | 346.8 | 4286.6 |
| 56 SEC. | 161.042 | 162.067 | 168.836 | 121.3 | 1447.1 | 159.4 | 1907.1 | 346.8 | 4633.4 |
| 57 SEC. | 160.693 | 162.077 | 168.273 | 110.6 | 1557.7 | 159.8 | 2066.9 | 346.8 | 4980.2 |
| 58 SEC. | 160.247 | 161.831 | 167.737 | 98.2 | 1655.9 | 149.7 | 2216.6 | 346.8 | 5327.0 |
| 59 SEC. | 159.554 | 161.278 | 167.094 | 81.7 | 1737.6 | 129.2 | 2345.8 | 346.8 | 5673.8 |
| 60 SEC. | 158.758 | 160.544 | 166.459 | 66.1 | 1803.7 | 106.3 | 2452.1 | 346.8 | 6020.6 |
| 61 SEC. | | | | | | | | | |
| 62 SEC. | w/ Tstar Arms (With Unbent Arms) | | | | | | | | |
| 63 SEC. | at Energy Star Water Levels | | | | | | | | |

Fig. 12b
(Prior Art)

Note: 346.8 value is max. HUE for any temp. above 165. 3.03E-17 0.265972 346.8

| TIme | Front | Center | Rear | HUE #1 | Total HUE | HUE #2 | Total HUE | HUE #3 | Total HUE #3 |
|---|---|---|---|---|---|---|---|---|---|
| 1 SEC. | 142.895 | 140.459 | 135.743 | 0.0 | 0.0 | 0.0 | 0.0 | 0.0 | 0.0 |
| 2 SEC. | 144.247 | 142.117 | 137.948 | 1.4 | 1.4 | 0.0 | 0.0 | 0.0 | 0.0 |
| 3 SEC. | 144.877 | 143.545 | 139.732 | 1.6 | 3.0 | 1.2 | 1.2 | 0.0 | 0.0 |
| 4 SEC. | 145.879 | 144.648 | 141.325 | 2.2 | 5.2 | 1.6 | 2.7 | 0.0 | 0.0 |
| 5 SEC. | 146.468 | 145.602 | 142.727 | 2.5 | 7.7 | 2.0 | 4.7 | 0.0 | 0.0 |
| 6 SEC. | 147.146 | 146.407 | 144.074 | 3.0 | 10.7 | 2.5 | 7.2 | 1.3 | 1.3 |
| 7 SEC. | 147.686 | 147.074 | 145.075 | 3.5 | 14.2 | 3.0 | 10.1 | 1.7 | 3.1 |
| 8 SEC. | 148.106 | 147.641 | 145.935 | 3.9 | 18.1 | 3.4 | 13.6 | 2.2 | 5.3 |
| 9 SEC. | 148.397 | 148.124 | 146.639 | 4.2 | 22.3 | 3.9 | 17.5 | 2.6 | 7.9 |
| 10 SEC. | 148.725 | 148.543 | 147.296 | 4.6 | 26.9 | 4.4 | 21.8 | 3.1 | 11.0 |
| 11 SEC. | 149.101 | 148.873 | 147.805 | 5.1 | 31.9 | 4.8 | 26.6 | 3.6 | 14.6 |
| 12 SEC. | 149.33 | 149.17 | 148.23 | 5.4 | 37.3 | 5.2 | 31.8 | 4.0 | 18.6 |
| 13 SEC. | 149.515 | 149.459 | 148.658 | 5.7 | 43.0 | 5.6 | 37.3 | 4.5 | 23.1 |
| 14 SEC. | 149.791 | 149.688 | 148.999 | 6.1 | 49.1 | 5.9 | 43.3 | 4.9 | 28.1 |
| 15 SEC. | 149.94 | 149.846 | 149.29 | 6.3 | 55.4 | 6.2 | 49.4 | 5.3 | 33.4 |
| 16 SEC. | 150.109 | 150.07 | 149.528 | 6.6 | 62.0 | 6.6 | 56.0 | 5.7 | 39.1 |
| 17 SEC. | 150.232 | 150.228 | 149.756 | 6.8 | 68.9 | 6.8 | 62.8 | 6.0 | 45.1 |
| 18 SEC. | 150.289 | 150.356 | 149.936 | 6.9 | 75.8 | 7.1 | 69.9 | 6.3 | 51.4 |
| 19 SEC. | 150.458 | 150.457 | 150.149 | 7.3 | 83.1 | 7.3 | 77.2 | 6.7 | 58.1 |
| 20 SEC. | 150.538 | 150.606 | 150.264 | 7.4 | 90.5 | 7.6 | 84.7 | 6.9 | 65.0 |
| 21 SEC. | 150.629 | 150.716 | 150.386 | 7.6 | 98.1 | 7.8 | 92.5 | 7.1 | 72.2 |
| 22 SEC. | 150.719 | 150.838 | 150.471 | 7.8 | 105.9 | 8.0 | 100.6 | 7.3 | 79.4 |
| 23 SEC. | 150.835 | 150.907 | 150.593 | 8.0 | 113.9 | 8.2 | 108.8 | 7.5 | 87.0 |
| 24 SEC. | 150.91 | 150.988 | 150.732 | 8.2 | 122.1 | 8.4 | 117.1 | 7.8 | 94.8 |
| 25 SEC. | 150.995 | 151.072 | 150.795 | 8.4 | 130.5 | 8.6 | 125.7 | 8.0 | 102.8 |
| 26 SEC. | 151.058 | 151.173 | 150.89 | 8.5 | 139.1 | 8.8 | 134.5 | 8.2 | 110.9 |
| 27 SEC. | 151.196 | 151.268 | 150.986 | 8.8 | 147.9 | 9.0 | 143.5 | 8.4 | 119.3 |
| 28 SEC. | 151.222 | 151.315 | 151.07 | 8.9 | 156.8 | 9.1 | 152.6 | 8.6 | 127.8 |
| 29 SEC. | 151.317 | 151.427 | 151.166 | 9.1 | 165.9 | 9.4 | 162.0 | 8.8 | 136.6 |
| 30 SEC. | 151.376 | 151.495 | 151.234 | 9.3 | 175.2 | 9.6 | 171.6 | 8.9 | 145.5 |
| 31 SEC. | 151.502 | 151.56 | 151.319 | 9.6 | 184.8 | 9.7 | 181.4 | 9.1 | 154.7 |

Fig. 13a

| | | | | | | | | | |
|---|---|---|---|---|---|---|---|---|---|
| 32 SEC. | 151.508 | 151.623 | 151.409 | 9.6 | 194.4 | 9.9 | 191.3 | 9.4 | 164.0 |
| 33 SEC. | 151.551 | 151.702 | 151.484 | 9.7 | 204.2 | 10.1 | 201.4 | 9.5 | 173.6 |
| 34 SEC. | 151.603 | 151.713 | 151.574 | 9.9 | 214.0 | 10.1 | 211.5 | 9.8 | 183.4 |
| 35 SEC. | 151.688 | 151.79 | 151.632 | 10.1 | 224.1 | 10.4 | 221.9 | 9.9 | 193.3 |
| 36 SEC. | 151.715 | 151.855 | 151.733 | 10.2 | 234.2 | 10.5 | 232.4 | 10.2 | 203.5 |
| 37 SEC. | 151.742 | 151.88 | 151.771 | 10.2 | 244.5 | 10.6 | 243.0 | 10.3 | 213.8 |
| 38 SEC. | 151.715 | 151.875 | 151.749 | 10.2 | 254.6 | 10.6 | 253.6 | 10.2 | 224.1 |
| 39 SEC. | 151.636 | 151.956 | 151.733 | 9.9 | 264.6 | 10.8 | 264.5 | 10.2 | 234.3 |
| 40 SEC. | 153.517 | 152.177 | 152.152 | 16.4 | 281.0 | 11.5 | 275.9 | 11.4 | 245.7 |
| 41 SEC. | 155.882 | 152.809 | 153.212 | 30.8 | 311.7 | 13.6 | 289.5 | 15.1 | 260.8 |
| 42 SEC. | 158.022 | 153.785 | 154.451 | 54.3 | 366.1 | 17.6 | 307.1 | 21.0 | 281.8 |
| 43 SEC. | 159.709 | 154.744 | 155.569 | 85.1 | 451.2 | 22.7 | 329.9 | 28.3 | 310.1 |
| 44 SEC. | 161.336 | 155.794 | 156.683 | 131.2 | 582.4 | 30.0 | 359.9 | 38.1 | 348.2 |
| 45 SEC. | 162.846 | 156.838 | 157.705 | 196.1 | 778.5 | 39.7 | 399.6 | 50.0 | 398.1 |
| 46 SEC. | 163.949 | 157.849 | 158.708 | 262.9 | 1041.4 | 51.9 | 451.5 | 65.2 | 463.4 |
| 47 SEC. | 164.932 | 158.846 | 159.646 | 341.5 | 1382.9 | 67.7 | 519.2 | 83.7 | 547.1 |
| 48 SEC. | 165.737 | 159.856 | 160.445 | 346.8 | 1729.7 | 88.5 | 607.7 | 103.5 | 650.6 |
| 49 SEC. | 166.136 | 160.843 | 161.244 | 346.8 | 2076.5 | 115.1 | 722.8 | 128.0 | 778.6 |
| 50 SEC. | 166.131 | 161.521 | 161.822 | 346.8 | 2423.3 | 137.8 | 860.6 | 149.3 | 928.0 |
| 51 SEC. | 166.043 | 162.061 | 162.252 | 346.8 | 2770.1 | 159.1 | 1019.7 | 167.4 | 1095.4 |
| 52 SEC. | 165.539 | 162.423 | 162.374 | 346.8 | 3116.9 | 175.2 | 1194.9 | 172.9 | 1268.3 |
| 53 SEC. | 165.092 | 162.61 | 162.374 | 346.8 | 3463.7 | 184.1 | 1379.1 | 172.9 | 1441.3 |
| 54 SEC. | 164.911 | 162.731 | 162.317 | 339.6 | 3803.3 | 190.2 | 1569.2 | 170.3 | 1611.6 |
| 55 SEC. | 164.723 | 162.79 | 162.153 | 323.0 | 4126.3 | 193.2 | 1762.4 | 163.1 | 1774.7 |
| 56 SEC. | 164.439 | 162.758 | 161.932 | 299.5 | 4425.8 | 191.5 | 1954.0 | 153.8 | 1928.4 |
| 57 SEC. | 163.487 | 162.736 | 161.523 | 232.5 | 4658.3 | 190.4 | 2144.4 | 137.9 | 2066.3 |
| 58 SEC. | 162.146 | 162.229 | 161.003 | 162.8 | 4821.1 | 166.4 | 2310.8 | 120.1 | 2186.4 |
| 59 SEC. | 160.763 | 161.518 | 160.51 | 112.7 | 4933.8 | 137.7 | 2448.5 | 105.3 | 2291.8 |
| 60 SEC. | 159.548 | 160.49 | 159.937 | 81.6 | 5015.3 | 104.8 | 2553.3 | 90.4 | 2382.2 |
| 61 SEC. | 158.477 | 159.529 | 159.41 | 61.3 | 5076.7 | 81.1 | 2634.4 | 78.6 | 2460.8 |
| 62 SEC. | 157.397 | 158.749 | 158.742 | 46.0 | 5122.7 | 65.9 | 2700.4 | 65.8 | 2526.7 |
| 63 SEC. | 156.299 | 158.081 | 157.973 | 34.4 | 5157.0 | 55.2 | 2755.6 | 53.6 | 2580.3 |
| 64 SEC. | 155.272 | 157.302 | 157.342 | 26.2 | 5183.2 | 44.9 | 2800.4 | 45.4 | 2625.7 |
| 65 SEC. | | | | | | | | | |
| 66 SEC. | | | | | | | | | |
| 67 SEC. | 1/2 arm angled inward | | | | | | | | |
| 68 SEC. | 5 sec dwell at end | | | | | | | | |

Fig. 13b

Note: 346.8 value is max. HUE for any temp. above 165. 3.03E-17 0.265972 346.8

| Time | Front | Center | Rear | HUE #1 | Total HUE | HUE #2 | Total HUE | HUE #3 | Total HUE #3 |
|---|---|---|---|---|---|---|---|---|---|
| 1 SEC. | 101.23 | 96.718 | 89.269 | 0.0 | 0.0 | 0.0 | 0.0 | 0.0 | 0.0 |
| 2 SEC. | 115.222 | 109.287 | 100.76 | 0.0 | 0.0 | 0.0 | 0.0 | 0.0 | 0.0 |
| 3 SEC. | 123.52 | 118.593 | 111.022 | 0.0 | 0.0 | 0.0 | 0.0 | 0.0 | 0.0 |
| 4 SEC. | 129.791 | 125.377 | 118.442 | 0.0 | 0.0 | 0.0 | 0.0 | 0.0 | 0.0 |
| 5 SEC. | 133.015 | 130.374 | 124.222 | 0.0 | 0.0 | 0.0 | 0.0 | 0.0 | 0.0 |
| 6 SEC. | 136.233 | 134.123 | 129.028 | 0.0 | 0.0 | 0.0 | 0.0 | 0.0 | 0.0 |
| 7 SEC. | 138.325 | 137.099 | 132.61 | 0.0 | 0.0 | 0.0 | 0.0 | 0.0 | 0.0 |
| 8 SEC. | 140.173 | 139.565 | 135.504 | 0.0 | 0.0 | 0.0 | 0.0 | 0.0 | 0.0 |
| 9 SEC. | 141.68 | 141.493 | 137.911 | 0.0 | 0.0 | 0.0 | 0.0 | 0.0 | 0.0 |
| 10 SEC. | 143.089 | 143.03 | 139.954 | 1.0 | 1.0 | 1.0 | 1.0 | 0.0 | 0.0 |
| 11 SEC. | 143.874 | 144.227 | 141.703 | 1.3 | 2.3 | 1.4 | 2.4 | 0.0 | 0.0 |
| 12 SEC. | 144.675 | 145.192 | 143.071 | 1.6 | 3.8 | 1.8 | 4.2 | 1.0 | 1.0 |
| 13 SEC. | 145.3 | 146.05 | 144.257 | 1.8 | 5.7 | 2.3 | 6.4 | 1.4 | 2.4 |
| 14 SEC. | 146.18 | 146.693 | 145.244 | 2.3 | 8.0 | 2.7 | 9.1 | 1.8 | 4.2 |
| 15 SEC. | 146.488 | 147.238 | 146.097 | 2.5 | 10.5 | 3.1 | 12.2 | 2.3 | 6.5 |
| 16 SEC. | 147.013 | 147.677 | 146.729 | 2.9 | 13.5 | 3.5 | 15.7 | 2.7 | 9.2 |
| 17 SEC. | 147.235 | 148.108 | 147.321 | 3.1 | 16.5 | 3.9 | 19.6 | 3.2 | 12.4 |
| 18 SEC. | 147.739 | 148.421 | 147.798 | 3.5 | 20.1 | 4.2 | 23.8 | 3.6 | 15.9 |
| 19 SEC. | 148.046 | 148.723 | 148.234 | 3.8 | 23.9 | 4.6 | 28.4 | 4.0 | 20.0 |
| 20 SEC. | 148.232 | 148.934 | 148.563 | 4.0 | 27.9 | 4.8 | 33.2 | 4.4 | 24.4 |
| 21 SEC. | 148.39 | 149.168 | 148.844 | 4.2 | 32.1 | 5.2 | 38.4 | 4.7 | 29.1 |
| 22 SEC. | 148.597 | 149.375 | 149.13 | 4.4 | 36.5 | 5.4 | 43.8 | 5.1 | 34.2 |
| 23 SEC. | 148.81 | 149.506 | 149.326 | 4.7 | 41.2 | 5.6 | 49.5 | 5.4 | 39.6 |
| 24 SEC. | 149.011 | 149.661 | 149.49 | 4.9 | 46.2 | 5.9 | 55.3 | 5.6 | 45.2 |
| 25 SEC. | 149.153 | 149.814 | 149.654 | 5.1 | 51.3 | 6.1 | 61.5 | 5.9 | 51.1 |
| 26 SEC. | 149.409 | 149.969 | 149.818 | 5.5 | 56.8 | 6.4 | 67.8 | 6.1 | 57.2 |
| 27 SEC. | 149.504 | 150.073 | 149.967 | 5.6 | 62.5 | 6.6 | 74.4 | 6.4 | 63.6 |
| 28 SEC. | 149.674 | 150.196 | 150.084 | 5.9 | 68.4 | 6.8 | 81.2 | 6.6 | 70.2 |
| 29 SEC. | 149.764 | 150.334 | 150.163 | 6.0 | 74.4 | 7.0 | 88.2 | 6.7 | 76.9 |
| 30 SEC. | 149.922 | 150.435 | 150.295 | 6.3 | 80.7 | 7.2 | 95.4 | 7.0 | 83.8 |
| 31 SEC. | 149.992 | 150.498 | 150.39 | 6.4 | 87.1 | 7.3 | 102.8 | 7.1 | 91.0 |
| 32 SEC. | 150.14 | 150.583 | 150.476 | 6.7 | 93.8 | 7.5 | 110.3 | 7.3 | 98.3 |
| 33 SEC. | 150.188 | 150.651 | 150.561 | 6.8 | 100.6 | 7.7 | 118.0 | 7.5 | 105.8 |
| 34 SEC. | 150.214 | 150.737 | 150.602 | 6.8 | 107.4 | 7.8 | 125.8 | 7.6 | 113.3 |
| 35 SEC. | 150.298 | 150.838 | 150.673 | 7.0 | 114.3 | 8.0 | 133.8 | 7.7 | 121.0 |
| 36 SEC. | 150.388 | 150.88 | 150.757 | 7.1 | 121.5 | 8.1 | 142.0 | 7.9 | 128.9 |
| 37 SEC. | 150.453 | 150.97 | 150.815 | 7.3 | 128.7 | 8.3 | 150.3 | 8.0 | 136.9 |
| 38 SEC. | 150.516 | 151.029 | 150.872 | 7.4 | 136.1 | 8.5 | 158.8 | 8.1 | 145.0 |
| 39 SEC. | 150.554 | 151.06 | 150.932 | 7.5 | 143.6 | 8.5 | 167.3 | 8.2 | 153.2 |
| 40 SEC. | 150.633 | 151.128 | 151.006 | 7.6 | 151.2 | 8.7 | 176.0 | 8.4 | 161.6 |
| 41 SEC. | 150.696 | 151.133 | 151.054 | 7.7 | 158.9 | 8.7 | 184.7 | 8.5 | 170.2 |
| 42 SEC. | 150.734 | 151.177 | 151.112 | 7.8 | 166.8 | 8.8 | 193.5 | 8.7 | 178.8 |
| 43 SEC. | 150.775 | 151.214 | 151.123 | 7.9 | 174.7 | 8.9 | 202.4 | 8.7 | 187.5 |

Fig. 14a

| | | | | | | | | | | |
|---|---|---|---|---|---|---|---|---|---|---|
| 44 SEC. | 150.829 | 151.304 | 151.207 | 8.0 | 182.7 | 9.1 | 211.5 | 8.9 | 196.3 | |
| 45 SEC. | 150.887 | 151.373 | 151.25 | 8.1 | 190.8 | 9.3 | 220.7 | 9.0 | 205.3 | |
| 46 SEC. | 150.847 | 151.349 | 151.254 | 8.1 | 198.9 | 9.2 | 229.9 | 9.0 | 214.3 | |
| 47 SEC. | 150.82 | 151.355 | 151.328 | 8.0 | 206.9 | 9.2 | 239.2 | 9.2 | 223.5 | |
| 48 SEC. | 151.807 | 153.194 | 153.113 | 10.4 | 217.3 | 15.0 | 254.2 | 14.7 | 238.2 | |
| 49 SEC. | 154.42 | 155.462 | 155.223 | 20.9 | 238.2 | 27.5 | 281.7 | 25.8 | 264.0 | |
| 50 SEC. | 156.821 | 157.428 | 157.142 | 39.5 | 277.7 | 46.4 | 328.1 | 43.0 | 307.0 | |
| 51 SEC. | 158.958 | 159.041 | 158.956 | 69.7 | 347.4 | 71.3 | 399.4 | 69.7 | 376.7 | |
| 52 SEC. | 160.749 | 160.407 | 160.519 | 112.3 | 459.6 | 102.5 | 501.9 | 105.6 | 482.3 | |
| 53 SEC. | 162.259 | 161.834 | 161.998 | 167.7 | 627.3 | 149.8 | 651.7 | 156.5 | 638.8 | |
| 54 SEC. | 163.661 | 162.974 | 163.255 | 243.5 | 870.9 | 202.9 | 854.6 | 218.6 | 857.4 | |
| 55 SEC. | 164.59 | 163.809 | 164.288 | 311.8 | 1182.7 | 253.3 | 1107.9 | 287.7 | 1145.1 | |
| 56 SEC. | 165.24 | 164.536 | 165.28 | 346.8 | 1529.5 | 307.3 | 1415.2 | 346.8 | 1491.9 | |
| 57 SEC. | 166.232 | 165.28 | 166.25 | 346.8 | 1876.3 | 346.8 | 1762.0 | 346.8 | 1838.7 | |
| 58 SEC. | 166.309 | 165.55 | 166.727 | 346.8 | 2223.1 | 346.8 | 2108.8 | 346.8 | 2185.5 | |
| 59 SEC. | 165.91 | 165.294 | 166.873 | 346.8 | 2569.9 | 346.8 | 2455.6 | 346.8 | 2532.3 | |
| 60 SEC. | 165.562 | 164.952 | 166.862 | 346.8 | 2916.7 | 343.3 | 2798.9 | 346.8 | 2879.1 | |
| 61 SEC. | 165.235 | 164.63 | 166.682 | 346.8 | 3263.5 | 315.1 | 3114.0 | 346.8 | 3225.9 | |
| 62 SEC. | 164.959 | 164.39 | 166.462 | 343.9 | 3607.4 | 295.6 | 3409.7 | 346.8 | 3572.7 | |
| 63 SEC. | 164.74 | 164.151 | 166.212 | 324.5 | 3931.9 | 277.4 | 3687.1 | 346.8 | 3919.5 | |
| 65 SEC. | 164.605 | 164.005 | 165.974 | 313.0 | 4244.9 | 266.9 | 3954.0 | 346.8 | 4266.3 | |
| 66 SEC. | 164.412 | 163.85 | 165.746 | 297.4 | 4542.3 | 256.1 | 4210.1 | 346.8 | 4613.1 | Normal En( |
| 67 SEC. | 164.291 | 163.735 | 165.532 | 288.0 | 4830.3 | 248.4 | 4458.4 | 346.8 | 4959.9 | |
| 68 SEC. | 164.189 | 163.593 | 165.344 | 280.2 | 5110.5 | 239.2 | 4697.6 | 346.8 | 5306.7 | |
| 69 SEC. | 163.719 | 163.462 | 165.152 | 247.3 | 5357.8 | 231.0 | 4928.6 | 346.8 | 5653.5 | |
| 70 SEC. | 162.886 | 163.129 | 164.871 | 198.2 | 5556.0 | 211.4 | 5140.0 | 336.0 | 5989.5 | |
| 71 SEC. | 161.681 | 162.191 | 164.3 | 143.8 | 5699.8 | 164.7 | 5304.7 | 288.6 | 6278.1 | |
| 72 SEC. | 160.585 | 161.246 | 163.589 | 107.5 | 5807.3 | 128.1 | 5432.8 | 238.9 | 6517.0 | |
| 73 SEC. | 159.57 | 160.213 | 162.572 | 82.0 | 5889.3 | 97.3 | 5530.1 | 182.3 | 6699.3 | |
| 74 SEC. | 158.69 | 159.428 | 161.851 | 64.9 | 5954.2 | 79.0 | 5609.1 | 150.5 | 6849.8 | |
| 75 SEC. | 157.784 | 158.611 | 161.237 | 51.0 | 6005.2 | 63.6 | 5672.7 | 127.8 | 6977.6 | |
| 76 SEC. | 156.719 | 157.801 | 160.711 | 38.4 | 6043.7 | 51.2 | 5724.0 | 111.1 | 7088.7 | After 10 sec. Dwell |
| 77 SEC. | | | | | | | | | | |
| 78 SEC. | With Bent Arms | | | | | | | | | |

Fig. 14b

Note: 346.8 value is max. HUE for any temp. above 165. 3.03E-17 0.265972 346.8

| TIme | Front | Center | Rear | HUE #1 | Total HUE | HUE #2 | Total HUE | HUE #3 | Total HUE |
|---|---|---|---|---|---|---|---|---|---|
| 1 SEC. | 114.655 | 102.839 | 98.327 | 0.0 | 0.0 | 0.0 | 0.0 | 0.0 | 0.0 |
| 2 SEC. | 125.87 | 115.781 | 108.428 | 0.0 | 0.0 | 0.0 | 0.0 | 0.0 | 0.0 |
| 3 SEC. | 132.178 | 124.522 | 116.908 | 0.0 | 0.0 | 0.0 | 0.0 | 0.0 | 0.0 |
| 4 SEC. | 136.703 | 130.651 | 123.8 | 0.0 | 0.0 | 0.0 | 0.0 | 0.0 | 0.0 |
| 5 SEC. | 138.816 | 135.013 | 128.83 | 0.0 | 0.0 | 0.0 | 0.0 | 0.0 | 0.0 |
| 6 SEC. | 140.648 | 138.222 | 133.013 | 0.0 | 0.0 | 0.0 | 0.0 | 0.0 | 0.0 |
| 7 SEC. | 142.069 | 140.643 | 136.346 | 0.0 | 0.0 | 0.0 | 0.0 | 0.0 | 0.0 |
| 8 SEC. | 143.285 | 142.463 | 138.974 | 1.1 | 1.1 | 0.0 | 0.0 | 0.0 | 0.0 |
| 9 SEC. | 144.27 | 143.915 | 141.071 | 1.4 | 2.5 | 1.3 | 1.3 | 0.0 | 0.0 |
| 10 SEC. | 145.134 | 145.109 | 142.751 | 1.8 | 4.2 | 1.8 | 3.0 | 0.0 | 0.0 |
| 11 SEC. | 145.665 | 146.047 | 144.076 | 2.0 | 6.3 | 2.2 | 5.3 | 1.3 | 1.3 |
| 12 SEC. | 146.243 | 146.794 | 145.172 | 2.4 | 8.6 | 2.7 | 8.0 | 1.8 | 3.1 |
| 13 SEC. | 146.614 | 147.325 | 146.041 | 2.6 | 11.3 | 3.2 | 11.2 | 2.2 | 5.4 |
| 14 SEC. | 147.298 | 147.829 | 146.821 | 3.1 | 14.4 | 3.6 | 14.8 | 2.8 | 8.1 |
| 15 SEC. | 147.625 | 148.246 | 147.461 | 3.4 | 17.8 | 4.0 | 18.8 | 3.3 | 11.4 |
| 16 SEC. | 148.034 | 148.57 | 147.976 | 3.8 | 21.6 | 4.4 | 23.2 | 3.8 | 15.2 |
| 17 SEC. | 148.162 | 148.835 | 148.279 | 3.9 | 25.6 | 4.7 | 27.9 | 4.1 | 19.2 |
| 18 SEC. | 148.442 | 149.069 | 148.671 | 4.3 | 29.8 | 5.0 | 33.0 | 4.5 | 23.7 |
| 19 SEC. | 148.685 | 149.306 | 148.941 | 4.5 | 34.4 | 5.4 | 38.3 | 4.9 | 28.6 |
| 20 SEC. | 148.925 | 149.486 | 149.195 | 4.8 | 39.2 | 5.6 | 43.9 | 5.2 | 33.8 |
| 21 SEC. | 149.116 | 149.636 | 149.434 | 5.1 | 44.3 | 5.8 | 49.8 | 5.5 | 39.3 |
| 22 SEC. | 149.285 | 149.751 | 149.54 | 5.3 | 49.6 | 6.0 | 55.8 | 5.7 | 45.0 |
| 23 SEC. | 149.413 | 149.884 | 149.758 | 5.5 | 55.1 | 6.2 | 62.0 | 6.0 | 51.1 |
| 24 SEC. | 149.582 | 150.028 | 149.879 | 5.8 | 60.9 | 6.5 | 68.5 | 6.2 | 57.3 |
| 25 SEC. | 149.729 | 150.16 | 149.996 | 6.0 | 66.9 | 6.7 | 75.2 | 6.4 | 63.7 |
| 26 SEC. | 149.8 | 150.287 | 150.17 | 6.1 | 73.0 | 6.9 | 82.2 | 6.7 | 70.5 |
| 27 SEC. | 149.958 | 150.345 | 150.23 | 6.4 | 79.3 | 7.1 | 89.2 | 6.8 | 77.3 |
| 28 SEC. | 150.08 | 150.424 | 150.34 | 6.6 | 85.9 | 7.2 | 96.4 | 7.0 | 84.3 |
| 29 SEC. | 150.206 | 150.547 | 150.451 | 6.8 | 92.7 | 7.4 | 103.9 | 7.3 | 91.6 |
| 30 SEC. | 150.329 | 150.62 | 150.511 | 7.0 | 99.7 | 7.6 | 111.5 | 7.4 | 99.0 |
| 31 SEC. | 150.35 | 150.716 | 150.622 | 7.1 | 106.8 | 7.8 | 119.3 | 7.6 | 106.6 |
| 32 SEC. | 150.403 | 150.737 | 150.658 | 7.2 | 114.0 | 7.8 | 127.1 | 7.7 | 114.2 |
| 33 SEC. | 150.478 | 150.797 | 150.754 | 7.3 | 121.3 | 8.0 | 135.0 | 7.9 | 122.1 |
| 34 SEC. | 150.557 | 150.865 | 150.77 | 7.5 | 128.7 | 8.1 | 143.1 | 7.9 | 130.0 |
| 35 SEC. | 150.61 | 150.907 | 150.827 | 7.6 | 136.3 | 8.2 | 151.3 | 8.0 | 138.0 |

Fig. 15a

| | | | | | | | | | |
|---|---|---|---|---|---|---|---|---|---|
| 36 SEC. | 150.732 | 150.961 | 150.887 | 7.8 | 144.1 | 8.3 | 159.6 | 8.1 | 146.2 |
| 37 SEC. | 150.716 | 151.002 | 150.95 | 7.8 | 151.9 | 8.4 | 168.0 | 8.3 | 154.4 |
| 38 SEC. | 150.775 | 151.013 | 150.934 | 7.9 | 159.8 | 8.4 | 176.5 | 8.3 | 162.7 |
| 39 SEC. | 150.748 | 151.103 | 151.007 | 7.9 | 167.7 | 8.6 | 185.1 | 8.4 | 171.1 |
| 40 SEC. | 150.86 | 151.13 | 151.045 | 8.1 | 175.7 | 8.7 | 193.8 | 8.5 | 179.6 |
| 41 SEC. | 150.896 | 151.178 | 151.105 | 8.2 | 183.9 | 8.8 | 202.6 | 8.6 | 188.2 |
| 42 SEC. | 150.955 | 151.204 | 151.13 | 8.3 | 192.2 | 8.9 | 211.5 | 8.7 | 196.9 |
| 43 SEC. | 151.024 | 151.263 | 151.157 | 8.4 | 200.7 | 9.0 | 220.5 | 8.8 | 205.7 |
| 44 SEC. | 151.013 | 151.294 | 151.204 | 8.4 | 209.1 | 9.1 | 229.5 | 8.9 | 214.5 |
| 45 SEC. | 150.986 | 151.326 | 151.236 | 8.4 | 217.4 | 9.2 | 238.7 | 8.9 | 223.5 |
| 46 SEC. | 150.997 | 151.326 | 151.279 | 8.4 | 225.8 | 9.2 | 247.9 | 9.0 | 232.5 |
| 47 SEC. | 151.258 | 151.438 | 152.053 | 9.0 | 234.8 | 9.4 | 257.3 | 11.1 | 243.6 |
| 48 SEC. | 154.215 | 152.185 | 153.887 | 19.7 | 254.6 | 11.5 | 268.8 | 18.1 | 261.7 |
| 49 SEC. | 156.933 | 153.547 | 155.615 | 40.7 | 295.3 | 16.5 | 285.3 | 28.7 | 290.4 |
| 50 SEC. | 158.391 | 155.471 | 157.273 | 60.0 | 355.2 | 27.6 | 312.9 | 44.5 | 334.9 |
| 51 SEC. | 161.021 | 156.946 | 159.251 | 120.7 | 475.9 | 40.8 | 353.7 | 75.4 | 410.3 |
| 52 SEC. | 162.574 | 158.254 | 160.803 | 182.4 | 658.3 | 57.8 | 411.5 | 113.9 | 524.2 |
| 53 SEC. | 164.452 | 159.552 | 162.018 | 300.6 | 958.8 | 81.6 | 493.2 | 157.3 | 681.5 |
| 54 SEC. | 164.923 | 160.969 | 163.264 | 340.7 | 1299.5 | 119.0 | 612.2 | 219.1 | 900.6 |
| 55 SEC. | 166.19 | 162.097 | 164.432 | 346.8 | 1646.3 | 160.7 | 772.8 | 299.0 | 1199.6 |
| 56 SEC. | 166.653 | 163.087 | 165.407 | 346.8 | 1993.1 | 209.1 | 981.9 | 346.8 | 1546.4 |
| 57 SEC. | 167.629 | 163.948 | 166.243 | 346.8 | 2339.9 | 262.8 | 1244.7 | 346.8 | 1893.2 |
| 58 SEC. | 166.928 | 164.732 | 166.783 | 346.8 | 2686.7 | 323.8 | 1568.5 | 346.8 | 2240.0 |
| 59 SEC. | 165.584 | 165.449 | 166.934 | 346.8 | 3033.5 | 346.8 | 1915.3 | 346.8 | 2586.8 |
| 60 SEC. | 164.997 | 165.755 | 166.856 | 347.4 | 3380.9 | 346.8 | 2262.1 | 346.8 | 2933.6 |
| 61 SEC. | 164.529 | 165.708 | 166.7 | 306.8 | 3687.7 | 346.8 | 2608.9 | 346.8 | 3280.4 |
| 62 SEC. | 164.363 | 165.562 | 166.545 | 293.5 | 3981.2 | 346.8 | 2955.7 | 346.8 | 3627.2 |
| 63 SEC. | 163.543 | 165.382 | 166.336 | 236.0 | 4217.2 | 346.8 | 3302.5 | 346.8 | 3974.0 |
| 65 SEC. | 162.88 | 165.157 | 165.818 | 197.9 | 4415.1 | 346.8 | 3649.3 | 346.8 | 4320.8 |
| 66 SEC. | 161.874 | 164.804 | 164.983 | 151.4 | 4566.5 | 330.1 | 3979.4 | 346.1 | 4666.9 |
| 67 SEC. | 160.771 | 164.255 | 164.074 | 112.9 | 4679.4 | 285.2 | 4264.6 | 271.8 | 4938.7 |
| 68 SEC. | 159.674 | 163.606 | 163.204 | 84.3 | 4763.7 | 240.0 | 4504.6 | 215.7 | 5154.4 |
| 69 SEC. | 159.107 | 162.621 | 162.135 | 72.5 | 4836.3 | 184.7 | 4689.3 | 162.3 | 5316.6 |
| 70 SEC. | 158.53 | 161.609 | 161.17 | 62.2 | 4898.5 | 141.1 | 4830.4 | 125.6 | 5442.2 |

(With Bent Arms)

Fig. 15b

| | Note: 346.8 value is max. HUE for any temp. above 165. | | | | | 3.03E-17 | 0.265972 | 346.8 | |
|---|---|---|---|---|---|---|---|---|---|
| Time | Front | Center | Rear | HUE #1 | Total HUE | HUE #2 | Total HUE | HUE #3 | Total HUE #3 |
| 1 SEC. | 115.533 | 112.882 | 105.158 | 0.0 | 0.0 | 0.0 | 0.0 | 0.0 | 0.0 |
| 2 SEC. | 124.009 | 122.206 | 114.66 | 0.0 | 0.0 | 0.0 | 0.0 | 0.0 | 0.0 |
| 3 SEC. | 129.109 | 128.216 | 121.399 | 0.0 | 0.0 | 0.0 | 0.0 | 0.0 | 0.0 |
| 4 SEC. | 132.03 | 132.025 | 126.567 | 0.0 | 0.0 | 0.0 | 0.0 | 0.0 | 0.0 |
| 5 SEC. | 135.124 | 134.876 | 130.55 | 0.0 | 0.0 | 0.0 | 0.0 | 0.0 | 0.0 |
| 6 SEC. | 136.814 | 137.027 | 133.38 | 0.0 | 0.0 | 0.0 | 0.0 | 0.0 | 0.0 |
| 7 SEC. | 138.625 | 138.798 | 135.803 | 0.0 | 0.0 | 0.0 | 0.0 | 0.0 | 0.0 |
| 8 SEC. | 139.475 | 140.056 | 137.569 | 0.0 | 0.0 | 0.0 | 0.0 | 0.0 | 0.0 |
| 9 SEC. | 140.38 | 141.118 | 138.919 | 0.0 | 0.0 | 0.0 | 0.0 | 0.0 | 0.0 |
| 10 SEC. | 140.917 | 141.975 | 140.159 | 0.0 | 0.0 | 0.0 | 0.0 | 0.0 | 0.0 |
| 11 SEC. | 141.593 | 142.646 | 141.259 | 0.0 | 0.0 | 0.0 | 0.0 | 0.0 | 0.0 |
| 12 SEC. | 142.087 | 143.14 | 142.061 | 0.0 | 0.0 | 1.0 | 1.0 | 0.0 | 0.0 |
| 13 SEC. | 142.762 | 143.575 | 142.679 | 0.0 | 0.0 | 1.2 | 2.2 | 0.0 | 0.0 |
| 14 SEC. | 143.244 | 144.009 | 143.177 | 1.1 | 1.1 | 1.3 | 3.5 | 1.0 | 1.0 |
| 15 SEC. | 143.516 | 144.317 | 143.6 | 1.1 | 2.2 | 1.4 | 4.9 | 1.2 | 2.2 |
| 16 SEC. | 143.663 | 144.56 | 144.036 | 1.2 | 3.4 | 1.5 | 6.4 | 1.3 | 3.5 |
| 17 SEC. | 143.96 | 144.794 | 144.328 | 1.3 | 4.7 | 1.6 | 8.1 | 1.4 | 5.0 |
| 18 SEC. | 144.189 | 144.995 | 144.581 | 1.4 | 6.1 | 1.7 | 9.8 | 1.5 | 6.5 |
| 19 SEC. | 144.268 | 145.132 | 144.835 | 1.4 | 7.5 | 1.8 | 11.5 | 1.6 | 8.1 |
| 20 SEC. | 144.511 | 145.238 | 144.963 | 1.5 | 9.0 | 1.8 | 13.3 | 1.7 | 9.8 |
| 21 SEC. | 144.661 | 145.323 | 145.116 | 1.6 | 10.5 | 1.9 | 15.2 | 1.8 | 11.6 |
| 22 SEC. | 144.819 | 145.462 | 145.26 | 1.6 | 12.1 | 1.9 | 17.1 | 1.8 | 13.4 |
| 23 SEC. | 144.931 | 145.568 | 145.35 | 1.7 | 13.8 | 2.0 | 19.1 | 1.9 | 15.2 |
| 24 SEC. | 145.073 | 145.658 | 145.462 | 1.7 | 15.6 | 2.0 | 21.1 | 1.9 | 17.2 |
| 25 SEC. | 145.211 | 145.71 | 145.598 | 1.8 | 17.4 | 2.1 | 23.2 | 2.0 | 19.2 |
| 26 SEC. | 145.291 | 145.789 | 145.647 | 1.8 | 19.2 | 2.1 | 25.3 | 2.0 | 21.2 |
| 27 SEC. | 145.391 | 145.885 | 145.775 | 1.9 | 21.1 | 2.2 | 27.4 | 2.1 | 23.3 |
| 28 SEC. | 145.544 | 145.949 | 145.843 | 2.0 | 23.0 | 2.2 | 29.6 | 2.1 | 25.4 |
| 29 SEC. | 145.645 | 146.066 | 145.944 | 2.0 | 25.1 | 2.3 | 31.9 | 2.2 | 27.6 |
| 30 SEC. | 145.741 | 146.162 | 146.007 | 2.1 | 27.1 | 2.3 | 34.2 | 2.2 | 29.8 |
| 31 SEC. | 145.789 | 146.182 | 146.081 | 2.1 | 29.2 | 2.3 | 36.5 | 2.3 | 32.1 |
| 32 SEC. | 145.879 | 146.246 | 146.167 | 2.2 | 31.4 | 2.4 | 38.9 | 2.3 | 34.4 |

Fig. 16a

| | | | | | | | | | |
|---|---|---|---|---|---|---|---|---|---|
| 33 SEC. | 145.958 | 146.299 | 146.241 | 2.2 | 33.6 | 2.4 | 41.3 | 2.4 | 36.8 |
| 34 SEC. | 146.048 | 146.342 | 146.304 | 2.2 | 35.8 | 2.4 | 43.7 | 2.4 | 39.2 |
| 35 SEC. | 146.065 | 146.389 | 146.299 | 2.3 | 38.1 | 2.5 | 46.2 | 2.4 | 41.6 |
| 36 SEC. | 146.149 | 146.457 | 146.378 | 2.3 | 40.4 | 2.5 | 48.7 | 2.5 | 44.1 |
| 37 SEC. | 146.182 | 146.527 | 146.443 | 2.3 | 42.7 | 2.6 | 51.3 | 2.5 | 46.6 |
| 38 SEC. | 146.261 | 146.549 | 146.468 | 2.4 | 45.1 | 2.6 | 53.8 | 2.5 | 49.1 |
| 39 SEC. | 146.318 | 146.628 | 146.558 | 2.4 | 47.5 | 2.6 | 56.5 | 2.6 | 51.6 |
| 40 SEC. | 146.408 | 146.702 | 146.574 | 2.5 | 50.0 | 2.7 | 59.1 | 2.6 | 54.2 |
| 41 SEC. | 146.468 | 146.745 | 146.653 | 2.5 | 52.5 | 2.7 | 61.8 | 2.6 | 56.9 |
| 42 SEC. | 146.484 | 146.77 | 146.718 | 2.5 | 55.1 | 2.7 | 64.6 | 2.7 | 59.6 |
| 43 SEC. | 146.5 | 146.824 | 146.74 | 2.5 | 57.6 | 2.8 | 67.3 | 2.7 | 62.3 |
| 44 SEC. | 146.495 | 146.84 | 146.749 | 2.5 | 60.1 | 2.8 | 70.1 | 2.7 | 65.0 |
| 45 SEC. | 146.452 | 146.83 | 146.765 | 2.5 | 62.6 | 2.8 | 72.9 | 2.7 | 67.7 |
| 46 SEC. | 149.096 | 147.629 | 147.713 | 5.1 | 67.7 | 3.4 | 76.3 | 3.5 | 71.2 |
| 47 SEC. | 152.303 | 149.665 | 150.428 | 11.9 | 79.6 | 5.9 | 82.2 | 7.2 | 78.4 |
| 48 SEC. | 155.299 | 151.578 | 153.004 | 26.3 | 105.9 | 9.8 | 92.0 | 14.3 | 92.7 |
| 49 SEC. | 156.877 | 153.121 | 155.263 | 40.1 | 146.0 | 14.8 | 106.7 | 26.1 | 118.8 |
| 50 SEC. | 158.632 | 154.822 | 157.027 | 63.9 | 209.9 | 23.2 | 129.9 | 41.7 | 160.5 |
| 51 SEC. | 161.107 | 156.481 | 158.749 | 123.5 | 333.4 | 36.1 | 166.0 | 65.9 | 226.5 |
| 52 SEC. | 161.971 | 158.045 | 160.087 | 155.4 | 488.7 | 54.7 | 220.7 | 94.1 | 320.6 |
| 53 SEC. | 163.525 | 159.529 | 161.613 | 234.9 | 723.6 | 81.1 | 301.9 | 141.3 | 461.8 |
| 54 SEC. | 165.01 | 161.278 | 163.022 | 346.8 | 1070.4 | 129.2 | 431.1 | 205.5 | 667.3 |
| 55 SEC. | 165.803 | 162.2 | 164.045 | 346.8 | 1417.2 | 165.1 | 596.2 | 269.7 | 937.0 |
| 56 SEC. | 166.957 | 162.974 | 165.062 | 346.8 | 1764.0 | 202.9 | 799.0 | 346.8 | 1283.8 |
| 57 SEC. | 166.432 | 163.982 | 165.312 | 346.8 | 2110.8 | 265.2 | 1064.3 | 346.8 | 1630.6 |
| 58 SEC. | 165.825 | 164.32 | 165.29 | 346.8 | 2457.6 | 290.2 | 1354.5 | 346.8 | 1977.4 |
| 59 SEC. | 165.123 | 164.362 | 165.125 | 346.8 | 2804.4 | 293.4 | 1647.9 | 346.8 | 2324.2 |
| 60 SEC. | 164.558 | 164.331 | 164.855 | 309.1 | 3113.6 | 291.0 | 1938.9 | 334.6 | 2658.8 |
| 61 SEC. | 164.158 | 164.221 | 164.522 | 277.9 | 3391.5 | 282.6 | 2221.6 | 306.2 | 2965.0 |
| 62 SEC. | 163.852 | 164.086 | 164.205 | 256.2 | 3647.7 | 272.7 | 2494.3 | 281.4 | 3246.4 |
| 63 SEC. | 163.561 | 164.003 | 163.894 | 237.1 | 3884.9 | 266.7 | 2761.0 | 259.1 | 3505.5 |
| 65 SEC. | 163.339 | 163.931 | 163.593 | 223.5 | 4108.4 | 261.7 | 3022.6 | 239.2 | 3744.7 |
| 66 SEC. | 163.132 | 163.827 | 163.361 | 211.6 | 4320.0 | 254.5 | 3277.2 | 224.9 | 3969.6 |
| 67 SEC. | 162.92 | 163.712 | 163.085 | 200.0 | 4519.9 | 246.9 | 3524.0 | 208.9 | 4178.5 |
| 68 SEC. | 162.072 | 163.577 | 162.774 | 159.6 | 4679.5 | 238.2 | 3762.2 | 192.4 | 4370.8 |
| 69 SEC. | 160.801 | 163.202 | 162.068 | 113.8 | 4793.3 | 215.5 | 3977.7 | 159.4 | 4530.3 |
| 70 SEC. | 159.741 | 162.497 | 160.801 | 85.9 | 4879.2 | 178.7 | 4156.4 | 113.8 | 4644.1 |
| 71 SEC. | 158.648 | 161.671 | 159.539 | 64.2 | 4943.4 | 143.4 | 4299.9 | 81.4 | 4725.4 |
| 72 SEC. | 157.7 | 160.769 | 158.544 | 49.9 | 4993.3 | 112.8 | 4412.7 | 62.4 | 4787.9 |
| 73 SEC. | 156.937 | 159.921 | 157.675 | 40.7 | 5034.0 | 90.1 | 4502.8 | 49.6 | 4837.4 |
| 74 SEC. | 156.22 | 159.052 | 156.784 | 33.7 | 5067.7 | 71.5 | 4574.2 | 39.1 | 4876.5 |
| 75 SEC. | 155.569 | 158.177 | 155.846 | 28.3 | 5096.0 | 56.6 | 4630.9 | 30.5 | 4907.0 |

(With Bent Arms)

Fig. 16b

SPRAY ARM FOR DIRECTING SPRAY IN A WAREWASHING MACHINE

CROSS-REFERENCE TO RELATED APPLICATIONS

The present application is claiming priority to U.S. Provisional Patent Application No. 61/190,971, filed Sep. 4, 2008, the content of which is herein incorporated by reference.

BACKGROUND

1. Field of the Disclosure

The present disclosure relates generally to spray of liquid in a warewashing machine and methods therefore. More particularly, the present disclosure relates to an arm for spraying liquid within a warewashing machine that is rotatable.

2. Description of Related Art

Warewashers have one or more arms that spray liquid or water onto wares, such as, glasses, utensils, plates, and the like. Warewashers may have wash arms and rinse arms. Wash arms recirculate water that includes detergent from a wash tank. Rinse arms within warewasher serve dual functions of removing chemical detergent left over after the wash cycle and imparting heat energy (commonly referred to as heat units) to the ware for sanitization purposes. Spray patterns are created by utilizing varying types of spray nozzles in conjunction with spray arms. Standards, such as, for example, government standards or Energy Star, require ever lowering water and energy consumption. Warewashers have water that is sprayed by the rinse arm nozzles that may miss an intended target wasting the water leading to inefficiency and increased water and energy consumption.

As shown in FIG. 2, an unbent arm 1 may rotate, as shown by arrows B, and be positioned to have water spray 110 pointed in a downward direction above one or more wares 300. Unbent arm 1 is free of bent portions. Unbent arm 1 has nozzles that spray streams A, B, and C. Streams A, B, and C of spray 110 of unbent arm 1 all do not contact or miss corner wares 320. By missing corner wares 320 water usage is increased leading to inefficiency.

As shown in FIG. 4, unbent arm 1 may rotate, as shown by arrows C, and be positioned to have water spray pointed in an upward direction below one or more wares 300. In contrast, when unbent arm 1 is below wares, streams A, B, and C of arm 1 contact corner wares, such as, for example, corner glasses 420. For example, streams A and C enter all of corner glasses 420.

Accordingly, it has been determined by the present disclosure, that there is a need for an arm having a spray pattern that maximizes a coverage area or maximizes contact with wares within a wash chamber of the warewasher. There is a further need for an arm that ensures that the water leaving the nozzles of the arm is not wasted by missing an intended target.

SUMMARY

An arm is provided that includes a tubular body that is rotatable. The tubular body has a first end portion, a second end portion and an intermediate portion between the first end portion and the second end portion. The first end portion is bent in a first direction forming a first angle with the intermediate portion, and the second end portion is bent in a second direction forming a second angle with the intermediate portion. A plurality of nozzles are disposed about the tubular body.

A warewashing machine is provided that includes a spray arm having a tubular body that is rotatable. The tubular body has a first end portion, a second end portion and an intermediate portion between the first end portion and the second end portion. The first end portion is bent in a first direction forming a first angle with the intermediate portion, and the second end portion is bent in a second direction forming a second angle with the intermediate portion. The spray arm has a plurality of nozzles disposed about the tubular body. A rack supports one or more wares contacted by a spray dispensed from the spray arm.

A method is also provided that includes rotating an arm that sprays liquid onto a ware. The arm has a first end portion, a second end portion and an intermediate portion between the first end portion and the second end portion. The first end portion is bent in a first direction forming a first angle with the intermediate portion, and the second end portion is bent in a second direction forming a second angle with the intermediate portion. The method also includes directing the liquid inward toward an axis of rotation by the first bent portion to counteract a forward momentum and a centrifugal force generated by the rotating of the arm so that a portion of liquid contacts the ware.

The above-described and other advantages and features of the present disclosure will be appreciated and understood by those skilled in the art from the following detailed description, drawings, and appended claims.

BRIEF DESCRIPTION OF THE DRAWINGS

FIGS. 12*a* and 12*b* is a table including example test data of a warewasher including unbent arms of FIG. 2 positioned above and below the wares pursuant to the prior art, FIG. 12*b* is a continuation of FIG. 12*a;*

FIG. 13 is a table including example test data of a warewasher including arms that each have one end that is bent inward and an opposite end that is unbent positioned above and below the wares;

FIGS. 14-16 are tables including example test data of a warewasher including arms of FIG. 1 positioned above and below the wares with bent portions at the ends thereof according to the present disclosure.

DETAILED DESCRIPTION OF THE PREFERRED EMBODIMENT

Figure 1:
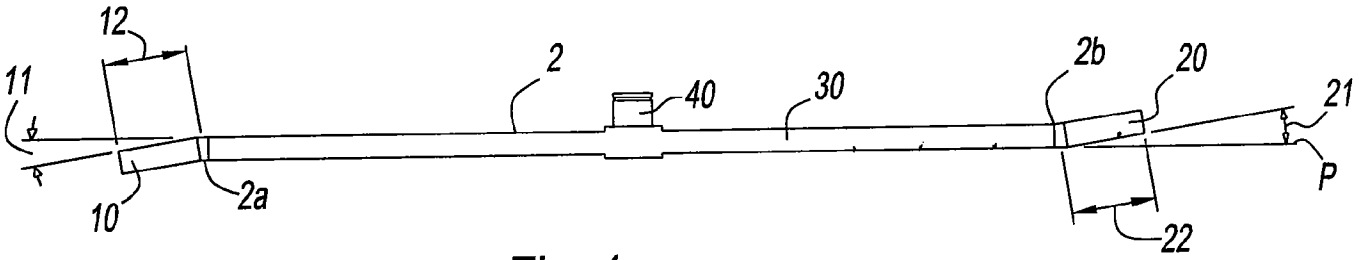
FIG. 1 is a side view of an exemplary embodiment of an arm according to the present disclosure.

Referring to the drawings and in particular to FIG. 1, an exemplary embodiment of an arm according to the present disclosure is generally referred to by reference numeral 2. Arm 2 is described herein as a rinse arm, however, arm 2 may be any arm included in a warewasher or dishwasher, such as, for example, a wash arm. Arm 2 may spray any liquid, such as, for example, water having detergent, however, arm 2 is described herein as spraying water.

Arm 2 is rotatable. Arm 2 has a first end portion 10, a second end portion 20, and an intermediate portion 30 between first end portion 10 and second end portion 20. Arm 2 may be plastic, stainless steel metal, or material that provides corrosion resistance to the chemicals used within warewashers. Plastic or stainless steel provide good corrosion resistance to the chemicals used within warewashers. First end portion 10 is bent at a point 2*a* outside of a plane of rotation P of intermediate portion 30 in a first direction forming an angle 11 with intermediate portion 30. Angle 11 may be, for example, from about 5 degrees to about 15 degrees. Point 2*a* is where first end portion 10 and intermediate portion 30 meet. First end portion 10 may have a length 12 of about 0.5 inches to about 5 inches. First end portion 20 is bent at a predetermined distance from a connector 40.

Figure 1A:
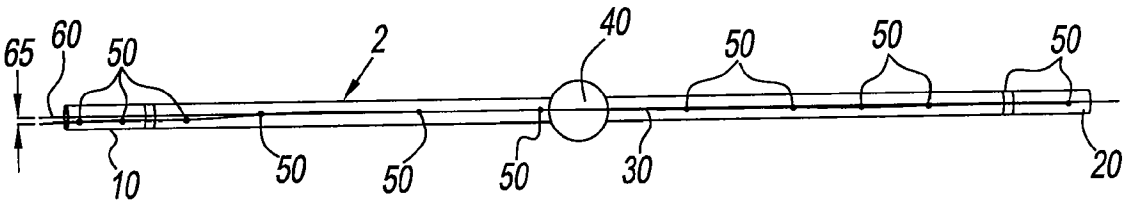
FIG. 1*a* is a top planar view of the arm of FIG. 1.
Figure 1C:
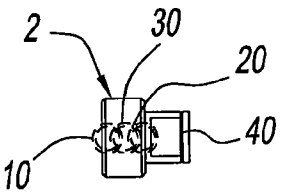
FIG. 1*c* is a end view of the arm of FIG. 1*a;*
Figure 1B:
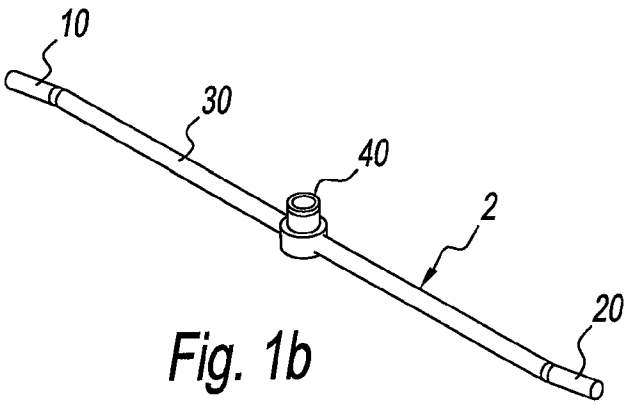
FIG. 1*b* is a top right side perspective view of the arm of FIG. 1.

Second end portion 20 is bent at a point 2*b* in a second direction outside of plane of rotation P of intermediate portion 30 forming an angle 21 with intermediate portion 30. The first direction and/or the second direction are in a direction that maximizes a coverage area or contact with water for a variety of ware placed within a wash chamber of the warewasher. The second direction is shown in FIGS. 1 through 1*c* as opposite the first direction, however, the first direction and second direction may be the same or any direction outside of plane of rotation P that maximizes a coverage area or contact with water for a variety of ware placed within a wash chamber of the warewasher. Angle 21 may be, for example, from about 5 degrees to about 15 degrees. Point 2*b* is where second end portion 20 and intermediate portion 30 meet. Second end portion 20 may have a length 22 of about 0.5 inches to about 5 inches. Second end portion 20 is bent at a predetermined distance from connector 40. First end portion 10 and second end portion 20 may be formed by bending an unbent tube.

Intermediate portion 30 connects first end portion 10 and second end portion 20. Intermediate portion 30 is unbent. Intermediate portion 30 is connected to connector 40. Connector 40 connects to the warewasher to receive water through connector 40 to be sprayed by first end portion 10, second end portion 20, and intermediate portion 30. Connector 40 may connect to the warewasher so that arm 2 is rotatable about connector 40.

Figure 10:
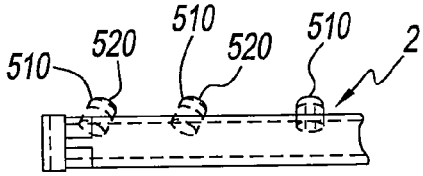
FIGS. 10 and 11 are partial enlarged views of oppositely disposed bent portions of an arm according to the present disclosure having angled nozzles disposed therein.
Figure 11:
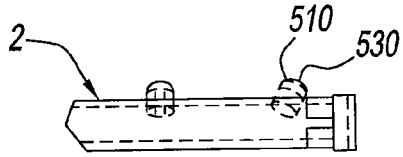
Figure 17:
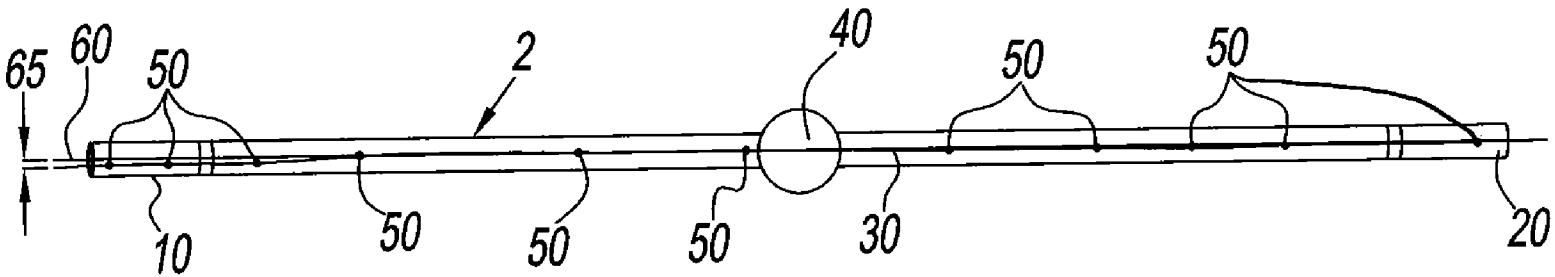
FIG. 17 is a top planar view of another exemplary embodiment of an arm according to the present disclosure.

Arm 2 has a plurality of nozzles 50. Plurality of nozzles 50 spray water that flows through arm 2. First end portion 10, second end portion 20, and intermediate portion 30 may each have one or more of plurality of nozzles 50. Plurality of nozzles 50 may be bored into arm 2. Plurality of nozzles 50 may be angled to direct spray into contact with one or more wares while arm 2 is rotating clockwise or counterclockwise. For example, as shown in FIGS. 10 and 11, directional nozzles 510 may be welded to arm 2. As shown in FIG. 10, first directional nozzles 520 may be welded on a portion of arm 2 that directs spray toward a center of rotation or connector 40. As shown in FIG. 11, second welded nozzle 530 may be welded on a portion of arm 2 that directs spray away from a center of rotation or connector 40. Referring now to FIG. 1*a*, plurality of nozzles 50 may be positioned at locations on arm 2 at an angle 65 with an axis 60 through arm 2. Angle 65 with axis 60 may be about 1 degree to about 45 degrees.

Figure 6:
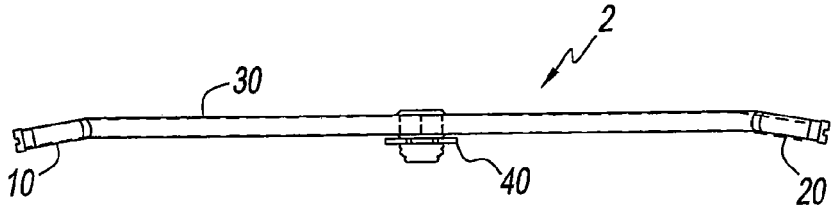
FIG. 6 is a side view of an exemplary embodiment of an arm according to the present disclosure with the bent arms angled downwards.
Figure 7:
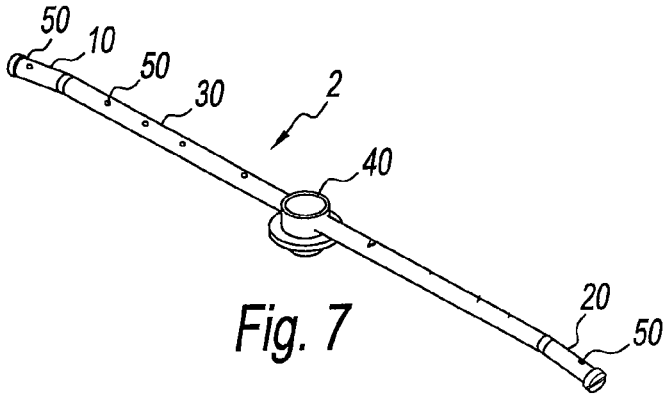
FIG. 7 is a top right side perspective view of the arm of FIG. 6.
Figure 8:
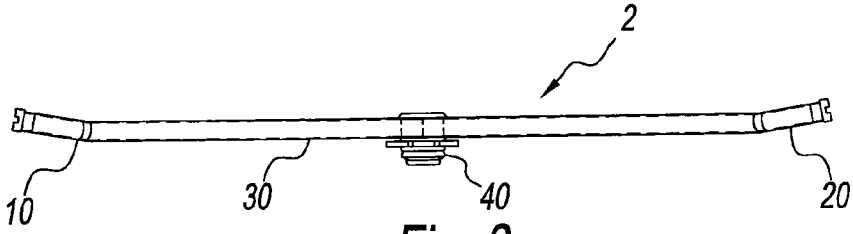
FIG. 8 is a side view of another embodiment of an arm according to the present disclosure with the bent portion angled upwards.
Figure 9:
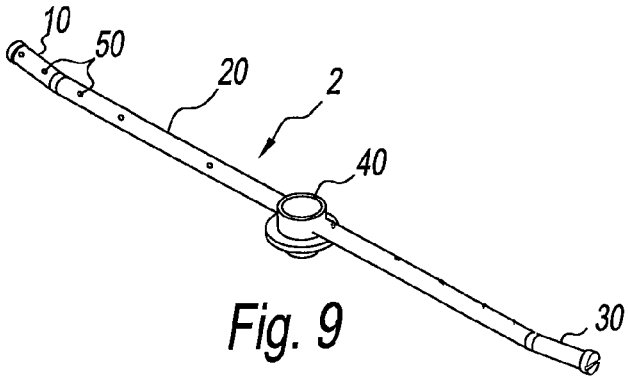
FIG. 9 is a top right side perspective view of the arm of FIG. 8.

As shown in FIGS. 6 through 9, first end portion 10 and second end portion 20 may be bent in the same direction so that the first direction and the second direction are the same. As shown in FIGS. 6 and 7, first end portion 10 and second end portion 20 may be bent directing nozzles away from a center of rotation or connector 40. As shown in FIGS. 8 and 9, first end portion 10 and second end portion 20 may be bent directing nozzles toward a center of rotation or connector 40. It has been found by the present disclosure that first end portion 10 and second end portion 20 that are bent directing nozzles away from a center of rotation maximizes contact with wares when arm 2 is positioned below a rack in a warewasher, and that first end portion 10 and second end portion 20 that are bent directing nozzles toward a center of rotation maximizes contact with wares when arm 2 is positioned above a rack in a warewasher.

Figure 3:
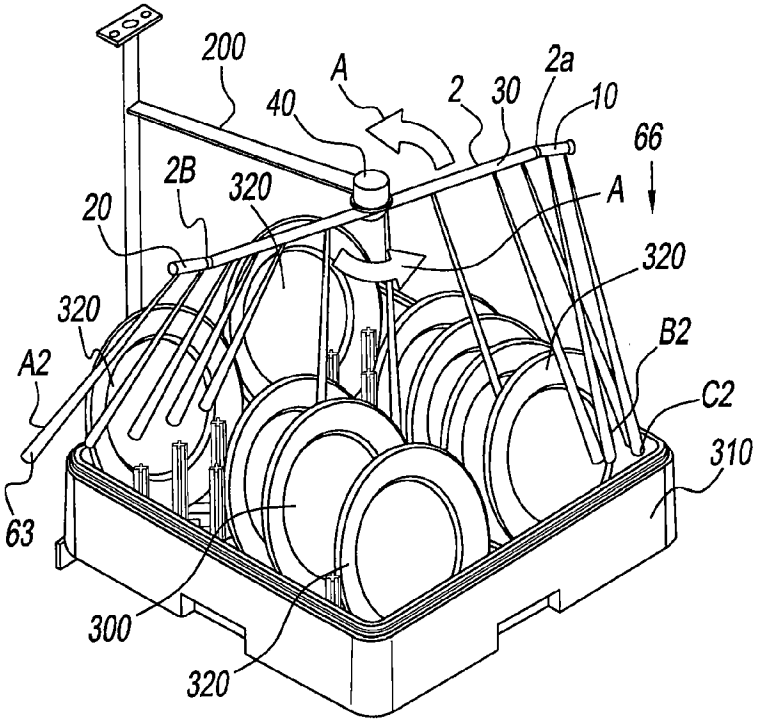
FIG. 3 is a top left side perspective view of a bent arm positioned above wares according to the present disclosure.

Referring now to FIG. 3, arm 2 is connected to tubing 200 by connector 40 to rotate, as shown by arrows A, and receive water therethrough to spray one or more wares 300. The spray from arm 2 to one or more wares removes chemical detergent left over after a wash cycle and imparts heat energy (commonly referred to as heat units) to the ware for sanitization purposes. One or more wares 300 may be on a rack 310. Rack 310 may have one or more apertures 320, a shown in FIG. 5.

The rotation of arm 2 contacts a higher area on one or more wares 300 than a stationary rinse arm. A reduction in the number of plurality of nozzles 50 may be achieved by the higher area resulting in a lower usage of water than the stationary arm. Plurality of nozzles 50 may be angled to direct spray into contact with one or more wares 300 while arm 2 is rotating clockwise or counterclockwise. Plurality of nozzles 50 may be positioned at locations on arm 2 at angle 65 with an axis 60 through arm 2, as shown in FIG. 1*a*.

It has been found by the present disclosure that rotation of spray may cause inefficiency in an arm that sprays wares due to an effect of the rotation on a spray stream exiting nozzles. As a droplet of water exits a rotating arm, a "forward" momentum or momentum of the droplet in the direction of rotation reduces a velocity of the droplet with which the droplet impacts wares that are stationary. The rotation of the arm creates a centrifugal force on the droplet as it exits a nozzle which will push the droplet slightly outward and in some cases beyond outer boundaries of the ware. Water sprayed from an arm that is not in contact or misses wares increases water usage leading to inefficiency. It is therefore critical to ensure that the highest percentage of water actually leaving plurality of nozzles 50 of arm 2 contacts ware and is not wasted by missing its intended target.

The effect of the centrifugal force on each droplet of a water stream will vary depending on a distance from a center of rotation of each nozzle as well as an angular velocity of the nozzle in relation to the center of rotation. The angular velocity can be determined by the formula: F=ma, where F is the centrifugal force, m is a mass of the water droplet and a is an acceleration in a rotating frame of reference. a can also be expressed as $\omega^2R$, where $\omega$ is angular rate of rotation and R is a distance from a center of rotation, for example, a center of rotation of arm 2 is located about where connector 40 connects to tubing 200. Accordingly, F=ma may be expressed $F=m\omega^2R$. It has further been found by the present disclosure that it is desirable for arm 2 to compensate for inefficiencies that may result from rotation. It is further desirable to compensate for inefficiencies that may result from rotation without a significant increase in cost of manufacture as provided by arm 2 of the present disclosure. a, ω, and R can vary depending upon design of the warewashing machine. For example, desirable results are achieved if the arm speed is maintained between about 30 rotations per minute (rpm) to about 100 rpm. It has also been determined by the present disclosure that first end portion 10 that is bent inward or toward a ware being sprayed directs liquid inward to counteract a forward momentum and a centrifugal force generated by the rotating of the arm so that a portion of liquid contacts the ware and decreases water usage leading to greater efficiency than an arm without first end portion 10.

As shown in FIG. 3, arm 2 may be positioned to have water spray pointed in a downward direction above one or more wares 300. First end portion 10 is bent toward a direction 66 of water spray 63 or toward one or more wares 300. Second end portion 20 is bent in an opposite direction 70 of water spray 63. First end portion 10 and second end portion 20 are bent within a predetermined tolerance. Advantageously found by the present disclosure, as shown by FIG. 3, first end portion 10 has streams B2 and C2 that contact corner wares 320. First end portion 10 may spray streams B2 and C2 at an angle of about 5 degrees to about 15 degrees less than the angles produced by a rotating unbent arm. Increasing contact of corner wares 320 decreases water usage and increases efficiency and heat energy transfer from the spray to the wares. Second end portion 20 may have a stream A2 that misses corner wares 320. Alternatively, second end portion 20 may be bent in the same direction as first end portion 10 and also include streams that contact corner wares 320 similar to first end portion 10 further decreasing water usage and increasing efficiency and heat energy transfer from the spray to the wares.

Figure 5:
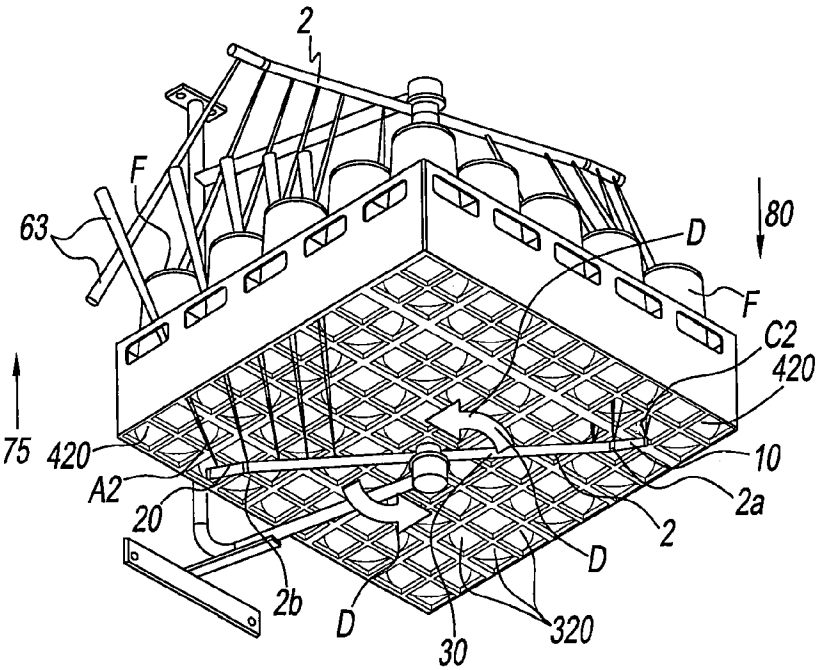
FIG. 5 is a bottom left side perspective view of bent arms positioned above and below the wares according to the present disclosure.
Figure 4:
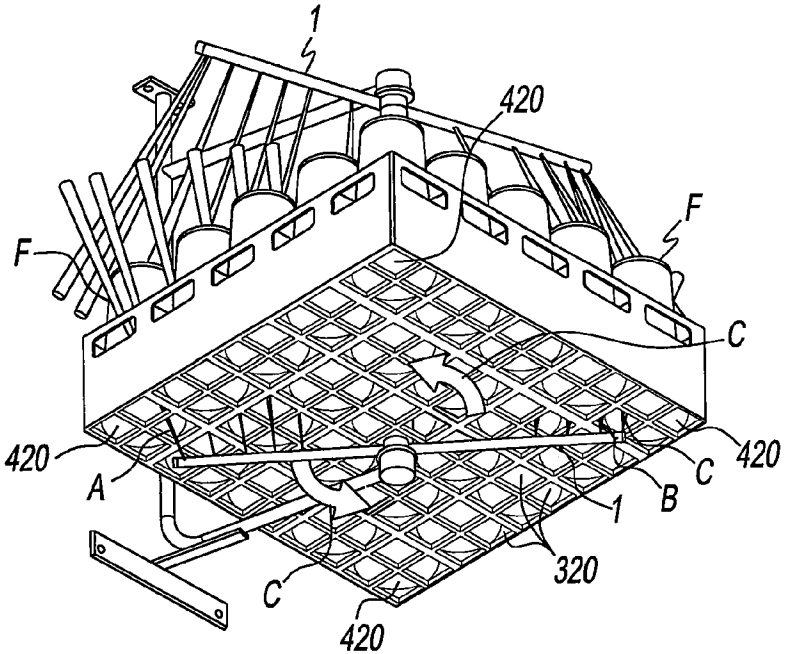
Fig. 4 (Prior Art)
FIG. 4 is a bottom left side perspective view of unbent arms positioned above and below the wares according to the prior art.

Any number of plurality of nozzles 50 may be on first portion 10, second portion 20, and intermediate portion 30. It has been found by the present disclosure that first end portion 10 with water streams B2, C2 having more of plurality of nozzles 50 than second end portion 20 advantageously increases efficiency and provides greater contact to one or more wares 300 than an unbent arm or a number of plurality of nozzles 50 of first end portion 10 that is less than or equal to second end portion 20 where second end portion 20 has a stream A2 that misses corner wares 320, as shown in FIG. 3. First end portion 10 having more of plurality of nozzles 50 than second end portion 20 ensures that an increased efficiency of water stream or streams B2, C2 created by first end portion that are directed inward or toward connector 40 are not overshadowed by streams created by second end portion 20 that point outward or away from connector 40. Nozzles pointed outward by second end portion 20 may have a greater chance of missing ware when arm 2 is in the upper position, as shown in FIG. 3, so that less heat may be transferred to ware from second end portion 20. Second end portion 20 adequately sprays all corner glasses of the rack when the arm 2 is in the lower position, as shown in FIG. 5. For example, first portion 10 having two of plurality of nozzles 50 generating streams B2 and C2 sprays more water that contacts corner wares 320 than second end portion 20 having one of nozzles 50 that has stream A2 that does not contact corner wares 320 so that more water contacts corner wares 320 than is lost or unused.

As shown in FIG. 5, arm 2 may rotate, as shown by arrows D, and be positioned to have water spray pointed in the upward direction below one or more wares 300. First end portion 10 is bent toward a direction 75 of water spray 63 or toward one or more wares 300. Second end portion 20 is bent in an opposite direction 80 of direction 75 of water spray 63. As discussed herein, stream C2 is effective for contacting corner wares when above the corner wares, as shown in FIG. 3. When positioned below wares, as shown in FIG. 5, stream C2 of arm 2 may contact less than all of corner glasses 420 and less than streams A, B, or C and be less effective than streams A, B, or C. However, advantageously, stream C2 may contact wares that are inside of corner glasses 420 when positioned below wares, as shown in FIG. 5. It has been found by the present disclosure that stream A2 of second end portion 20 contacts corner glasses 420 so that adequate coverage for detergent removal as well as heat transfer to corner glasses is achieved where stream C2 contacts less than all of corner glasses 420. Second end portion 20 may spray stream A2 at an angle of about 5 degrees to about 15 degrees greater (away from the vertical) than spray from nozzles in a rotating unbent arm. Alternatively, first end portion 10 may be bent in the same direction as second end portion 20 and also include streams that contact all of corner glasses similar to second end portion 20 further decreasing water usage and increasing efficiency and heat energy transfer from the spray to the wares, when the arm is in the lower position, as shown in FIG. 5.

As shown in FIGS. 3 and 5, arm 2 having first end portion 10 bent in a first direction and second end portion 20 bent in a second direction that is opposite the first direction may be used above one or more wares 300, as shown in FIG. 3, or below one or more wares 300, as shown in FIG. 5. Advantageously arm 2 cannot be improperly installed in a warewasher that has an arm above wares and an arm below wares, for example by workers that maintain or install arm 2, because arm 2 can be used above one or more wares or below one or more wares as described herein so that arm 2 is universal. The ideal configuration for a system would be to have the upper arm with both bends inward (maximizing spray from above) and the lower arm having both bends in the outward direction (maximizing spray coverage to corner glasses from below). The universal arm 2 prevents "keying" of the manifolds to ensure the correct arm is in the correct position and reduces the number of parts required for the warewasher.

Figure 2:
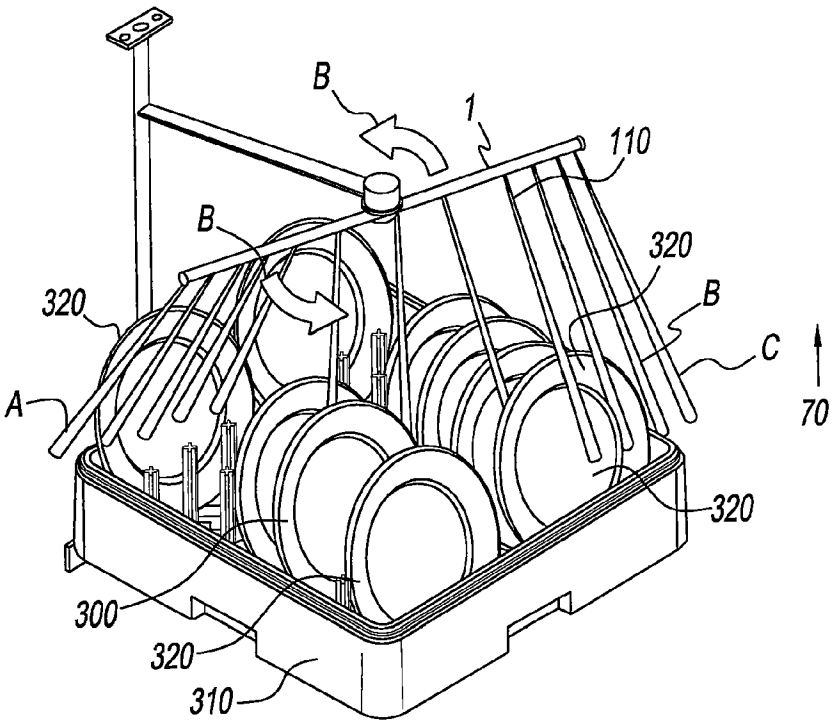
Fig. 2 (Prior Art)
FIG. 2 is a top left side perspective view of an unbent arm positioned above wares according to the prior art.

Tests of spray arms were conducted according to National Sanitation Foundation/American National Standards Institute (NSF/ANSI) Standard 3, sections 6.1 and 6.2 or "huey" test that records heat units imparted to ware by both wash water and rinse water. Example test results are shown in FIGS. 12*a* through 16*b* for door type warewashing machines. A value of 3,600 is a minimum value to meet the standard set forth in NSF/ANSI Standard 3 sections 6.1 and 6.2. FIGS. 12*a* and 12*b* is a table including example test data of a warewasher including unbent arms of FIG. 2 positioned above and below the wares where water consumption levels were reduced to that required by Energy Star so that a high temperature sanitizing door machine can not exceed 0.90 gallons per rack. FIGS. 13*a* and 13*b* is a table including example test data of a warewasher including arms that each have one end that is bent inward and an opposite end that is unbent positioned above and below the wares. FIGS. 14*a*-16*b* are tables including example test data of a warewasher including arms of FIG. 1 positioned above and below the wares. As shown in FIGS. 12*a*-16*b*, arm 2 including first end portion 10 and second end portion 20 bent in opposite directions, as shown in FIGS. 1 through 1*c* gain approximately 500 to 1000 heat units over spray arms that are unbent using wash water and rinse water of the same temperature.

It should also be noted that the terms "first", "second", "third", "upper", "lower", "above", "below", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A warewashing spray arm comprising:

a tubular body that is rotatable, said tubular body has a first end portion, a second end portion and an intermediate portion disposed between said first end portion and said second end portion, said first end portion being bent in a first direction forming a first angle with said intermediate portion, and said second end portion being bent in a second direction forming a second angle with said intermediate portion; and a plurality of nozzles through said tubular body, at least a first nozzle of said plurality of nozzles being through said first end portion and at least a second nozzle of said plurality of nozzles being through said second end portion, wherein said intermediate portion is rotatable in a plane of rotation about an axis of rotation, and wherein said first end portion is bent in said first direction along a first vertical plane out of said plane of rotation so that said first nozzle initially directs fluid toward said axis of rotation and said second end portion is bent in said second direction along a second vertical plane out of said plane of rotation so that said second nozzle initially directs fluid away from said axis of rotation, and wherein said first direction and said second direction are on opposite sides of said plane of rotation.

2. The arm of claim 1, wherein said first angle is about 5 degrees to about 15 degrees.

3. The arm of claim 1, wherein said second angle is about 5 degrees to about 15 degrees.

4. The arm of claim 1, wherein said first end portion has a length of about 0.5 inches to about 5 inches.

5. The arm of claim 1, wherein said second end portion has a length of about 0.5 inches to about 5 inches.

6. The arm of claim 1, wherein said intermediate portion has a connector that rotatably connects the arm to a warewashing machine.

7. The arm of claim 1, wherein said plurality of nozzles are positioned on said tubular body forming an angle with an axis through the arm between about 1 degree to about 45 degrees.

8. The arm of claim 1, wherein said intermediate portion is unbent.

9. The arm of claim 1, wherein said first end portion has a first amount of said plurality of nozzles that is greater than a second amount of said plurality of nozzles on said second end portion.

10. A warewashing machine comprising:

a spray arm having a tubular body that is rotatable, said tubular body has a first end portion, a second end portion and an intermediate portion disposed between said first end portion and said second end portion, said first end portion being bent in a first direction forming a first angle with said intermediate portion, and said second end portion being bent in a second direction forming a second angle with said intermediate portion, said spray arm having a plurality of nozzles through said tubular body; and a rack that supports one or more wares that are contacted by a spray dispensed from said spray arm, wherein said first end portion is bent in said first direction along a first vertical plane toward said rack, and wherein said second end portion is bent in said second direction along a second vertical plane away from said rack.

11. The warewashing machine of claim 10, wherein said spray arm is a first spray arm on a first side of said rack, and further comprising a second spray arm that is the same as said first arm positioned on a second side of said rack opposite said first side.

* * * * *